US006494247B1

(12) United States Patent
Pedone

(10) Patent No.: US 6,494,247 B1
(45) Date of Patent: Dec. 17, 2002

(54) MODULAR LOCKING PANEL SYSTEM FOR TRADE SHOW EXHIBITS

(76) Inventor: Leonard Pedone, 301 Pin Oak Rd., Stroudsburg, PA (US) 18360

( * ) Notice: Subject to any disclaimer, the term of this patent is extended or adjusted under 35 U.S.C. 154(b) by 0 days.

(21) Appl. No.: 09/672,574

(22) Filed: Sep. 28, 2000

Related U.S. Application Data

(60) Provisional application No. 60/156,830, filed on Sep. 30, 1999.

(51) Int. Cl.[7] ..... A47G 5/00
(52) U.S. Cl. ..... 160/135
(58) Field of Search ..... 160/135, 351, 160/352; 52/239, 238.1

(56) References Cited

U.S. PATENT DOCUMENTS 4,958,671 A * 9/1990 Bove ..... 160/135
5,179,810 A * 1/1993 Gename et al. ..... 160/135 X
5,220,952 A * 6/1993 Beaulieu ..... 160/135
5,491,943 A * 2/1996 Vondrejs et al. ..... 160/135 X
5,803,146 A * 9/1998 Boon ..... 160/135

OTHER PUBLICATIONS

One page color two–sided brochure entitled "Series 3000 4000 5000: Cost Effective Versatility" (date unknown).
Three page color two–sided brochure entitled "The New Design: mila–wall®Partition Walls: Design 90" of MBA Design & Display Products Corp. (date unknown).

* cited by examiner

*Primary Examiner*—David M. Purol
(74) *Attorney, Agent, or Firm*—Charles N. Quinn

(57) ABSTRACT

The present invention is a modular exhibit assembly adapted for rapid set up and breakdown, having interlocking rectangular framing sections each with independently attached and replaceable overlay skins. The rectangular framing sections are connected by abutting hollow peripheral members, placing one insert filler within each peripheral member, fastening the insert filler to the member by a socket set screw assembly, and engaging a rotatable latching member of one insert filler to a latching receptacle member of a second insert filler, thereby interlocking the two peripheral members. Overlay holders are attached to a framing member, or placed and secured between the interlocking peripheral members, and overlay skins are attached to the framing members by inserting the overlay skins into the overlay holders.

12 Claims, 20 Drawing Sheets

MODULAR LOCKING PANEL SYSTEM FOR TRADE SHOW EXHIBITS

RELATED APPLICATIONS

The present application claims priority from pending provisional application 60/156,830, filed on Sep. 30, 1999, entitled "Modular Locking Panel System for Trade Show Exhibits," which is incorporated in its entirety herein by this reference.

FIELD OF THE INVENTION

This invention relates generally to an exhibit apparatus for trade shows and the like, and more particularly to a modular locking panel system configured for simple and rapid set up and breakdown.

BACKGROUND OF THE INVENTION

Display panel systems are commercially significant products with broad application to the communication of information relating to education, sales, marketing, and advertising. Such systems are commonly used in a variety of locations, such as trade shows, conventions, conferences, and the like. The success of these systems depends greatly upon the ability to convey this information to as broad an audience as possible. Accordingly, display panel systems are best able to achieve this goal when they are readily portable, affordable to transport, erect, and disassemble, and adaptable to varying display needs.

Existing display panel systems are commonly cumbersome to transport, erect, and disassemble, incurring unnecessary cost that limits the use of such a system. Traditional wood panels are constructed with plywood or solid lumber and are nailed together. Roto-lock devices are used in wood panels to lock panels together. However, skins are permanently nailed to frames and are belt sanded to fit adjoining panels then they are laminated with a Formica-type laminate. The wood panels are heavy, awkward to handle and are not modular. When a new finish or configuration is desired, old wood frame panels are discarded and new ones are constructed.

Further, existing display panel systems commonly employ a sliding button/channel system for interconnection of the panels. In such a system, a button mounted on the post of a first panel slides into the channel of a second panel, fastening the panels at that particular point. Such a structure is known to have limited structural integrity, since the buttons must be free to slide and thus cannot engage the channel in a firm, tight manner.

SUMMARY OF THE INVENTION

This invention provides a display panel system that overcomes the aforementioned shortcomings and disadvantages of the previously available display units. The display panel system of this invention assembles quickly, easily, and securely into a structurally sound unit. The display system of this invention is additionally cost-efficient through the use of custom extrusions and a totally modular system that permits replacement of the overlay skin without the expense of replacing the entire frame. Further, the custom extrusions are designed to be lightweight, overcoming the weight-based deficiencies of existing display panel systems.

This invention provides a modular exhibit assembly adapted for rapid set up and breakdown comprising a plurality of rectangular frames, each adapted for supporting an overlay skin in a generally vertical plane. The frames comprise a plurality of longitudinally elongated peripheral members, each having a hollow interior extending the longitudinal length of the peripheral member. The peripheral members are generally rectangular in cross-section with one side of the rectangular cross-section having an open channel running the longitudinal length of the peripheral member. The peripheral members connect together and define a generally rectangular frame, with one end of each elongated peripheral member abutting one side of an adjacent peripheral member, such that the open channels face outwardly respecting the rectangular interior of the frame.

In one configuration, the plurality of frames are attached to each other in a coplanar orientation via their respective peripheral members, the adjoining peripheral members being connected along their longitudinal length. The attachment is accomplished using longitudinally elongated insert fillers. The longitudinally elongated insert fillers are inserted into the hollow interior of the adjoining peripheral members. A first insert filler has a latch member attached thereto, wherein the latch member faces outwardly through the first channel of a first adjoining peripheral member. A second insert filler has a latch receptacle member attached thereto, wherein the latch receptacle member faces outwardly through the first channel of a second adjoining peripheral member. The latch member and latch receptacle member of the two insert fillers mate to join the two respective peripheral members together.

As a further aid to assembly, the insert fillers have alignment members attached thereto to assist in orienting the aforementioned first and second insert fillers.

The insert fillers further have set screws attached thereto. The set screws extend inwardly into the hollow interior of the peripheral members and abut the peripheral member wall that is opposite to the first open channel. The set screws bias the insert fillers frictionally against a wall containing the first open channel of the peripheral member.

In a second configuration, the plurality of frames is attached to each other at prespecified angles via corner members. However, the corner members share various features in common with the elongated peripheral members. Namely, they have longitudinally extending open channels and hollow interiors extending the longitudinal length. Specifically, the corner members have two opposing open channels and two associated hollow interiors. The orientation between these two opposing open channels defines the pre-specified angle.

These open channels and hollow interiors accept longitudinally elongated insert fillers in the same manner as the elongated peripheral members described above. Each corner member in fact accepts two longitudinally elongated insert fillers. Each of these two insert fillers mate with a respective insert filler which has been previously mounted in a peripheral member of a frame. Thus, two frame members are joined to each other at the pre-specified angle of the corner member.

In a third configuration, the plurality of frames is attached directly to each other via a hinge member. The hinge member attaches to longitudinal surfaces of the peripheral members that do not contain the first open channels of the peripheral members. Attachment of the hinge member is accomplished by screws, bolts, or like fasteners. Alternately, the hinge member may be permanently mounted to the peripheral members by welding. The hinged peripheral members further attach to the aforementioned frame members in the manner described above utilizing the insert fillers.

The modular exhibit assembly of any of the above three configurations further comprises a plurality of overlay holders for retaining overlay skins to the frames. The overlay holders permit replacement of the overlay skins independently from the frame obviating the expense of replacing the entire frame.

The longitudinally elongated peripheral members can be extruded. Alternatively, the members can comprise aluminum, steel, brass, plastic, or a composite material.

The modular locking panel system can be used for trade show exhibits, window display walls, office partitions, ceiling canopies, lightboxes with plexiglass inserts, kiosks, double-level displays, and various other purposes.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE INVENTION

Figure 1:
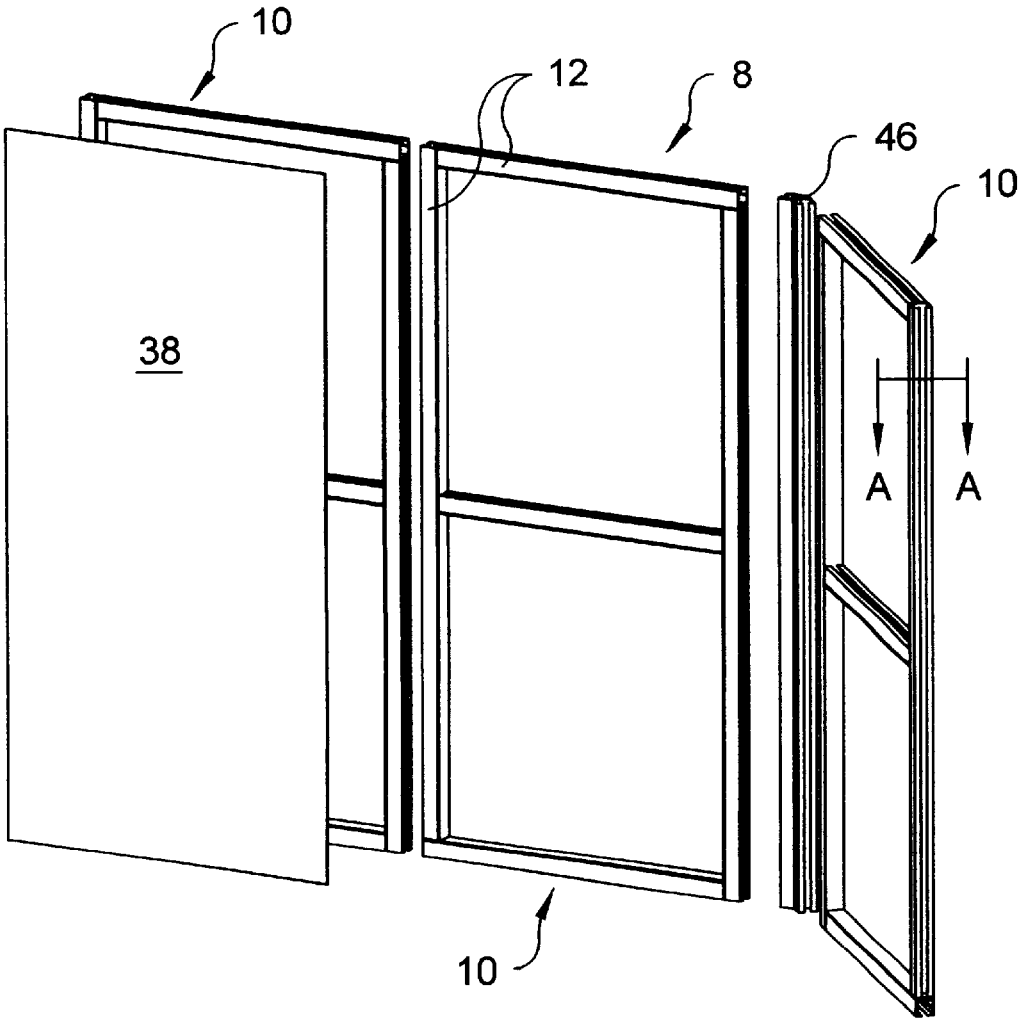
FIG. 1 is an isometric view of a plurality of rectangular frames adapted with a corner member for supporting a display in a generally vertical plane, schematically depicting an overlay skin to be attached to the frames, with the frames separated one from another, manifesting aspects of the invention.

Referring now to the drawings, wherein like numerals indicate like elements, there is shown in FIG. 1 an illustration of a modular locking panel system embodying the invention is shown. Three frames 10 are depicted in vertically upright orientation. The frames 10 comprise horizontal and vertical longitudinally elongated peripheral members 12 to which the overlay skin 38 attaches. The horizontal peripheral members 12 abut the vertical peripheral members 12 at each end in coplanar disposition to form the generally rectangular outline of frames 10. Also shown is corner peripheral member 46. The system 8 is shown partially assembled with frames 10, the overlay skin 38, and the corner peripheral member 46 placed proximal to one another in the same relative positions as the assembled system depicted in FIG. 2.

Figure 2:
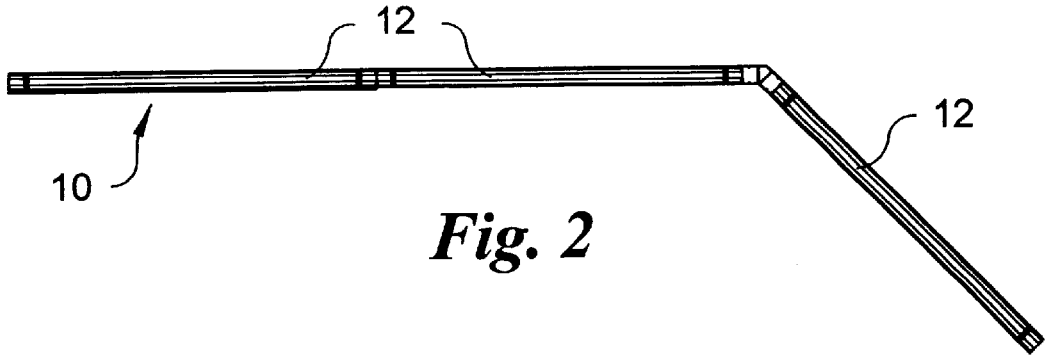
FIG. 2 is a top view of the frames illustrated in FIG. 1 but with the frames connected one to another.

A top view of the modular locking panel system of FIG. 1 is illustrated in FIG. 2, but with the frames connected one to another. The combined views of FIG. 1 and FIG. 2 depict generally the usage of the modular locking panel system of the current invention.

Figure 3:
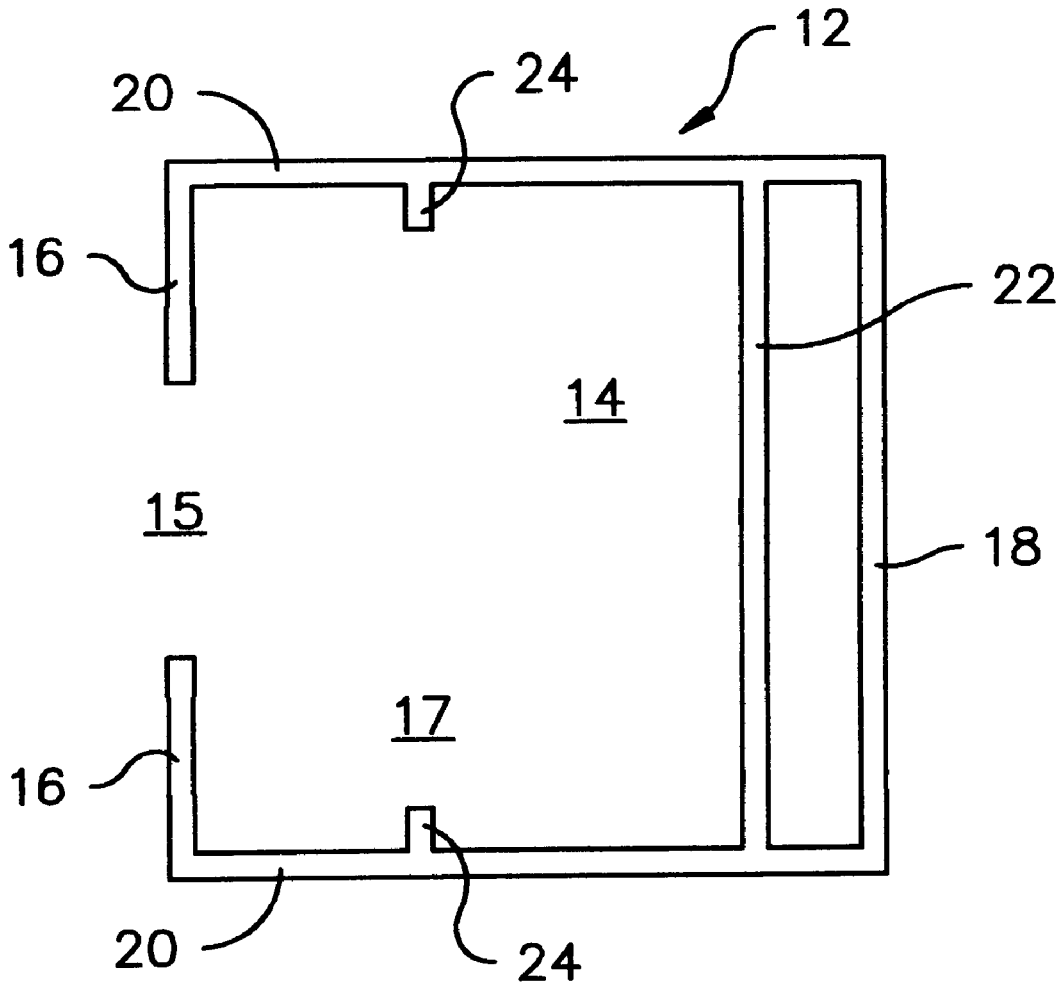
FIG. 3 is a sectional view, taken along direction "A", of a member forming the periphery of the frames illustrated in FIG. 1.

In a first embodiment, longitudinally elongated peripheral member 12 is shown in cross-section in FIG. 3. The peripheral member 12 comprises a pair of longitudinally elongated coplanar first exterior walls 16 separated one from another in a first transverse direction. The separation defines a first longitudinally extending open channel 15, which is open at respective ends of the members prior to assembly of the peripheral members one to another.

Peripheral member 12 further comprises a second exterior wall 18 parallel with the first exterior walls 16 and spaced therefrom in a second transverse direction. The peripheral member 12 yet further comprises a parallel pair of third exterior walls 20 connecting respective ones of the first exterior walls 16 with the second exterior wall 18. First, second, and third walls 16, 18, 20 form a generally rectangular shape enclosing a hollow interior 14 of the peripheral member 12.

The peripheral member 12 still further comprises a pair of longitudinally elongated coplanar guide members 24 separated one from another in the first transverse direction along their longitudinal length. The guide members 24 are parallel with the first exterior walls 16 and are disposed between the first exterior walls 16 and the second exterior wall 18. The separation between the guide members 24 defines a second longitudinally extending open channel 17.

The peripheral member 12 yet still further comprises a longitudinally elongated interior wall 22 parallel to and disposed between the second exterior wall 18 and the guide members 24. The interior wall 22 adjoins along its longitudinal length, which is perpendicular to the plane of the drawing, the third exterior walls 22.

Figure 4:
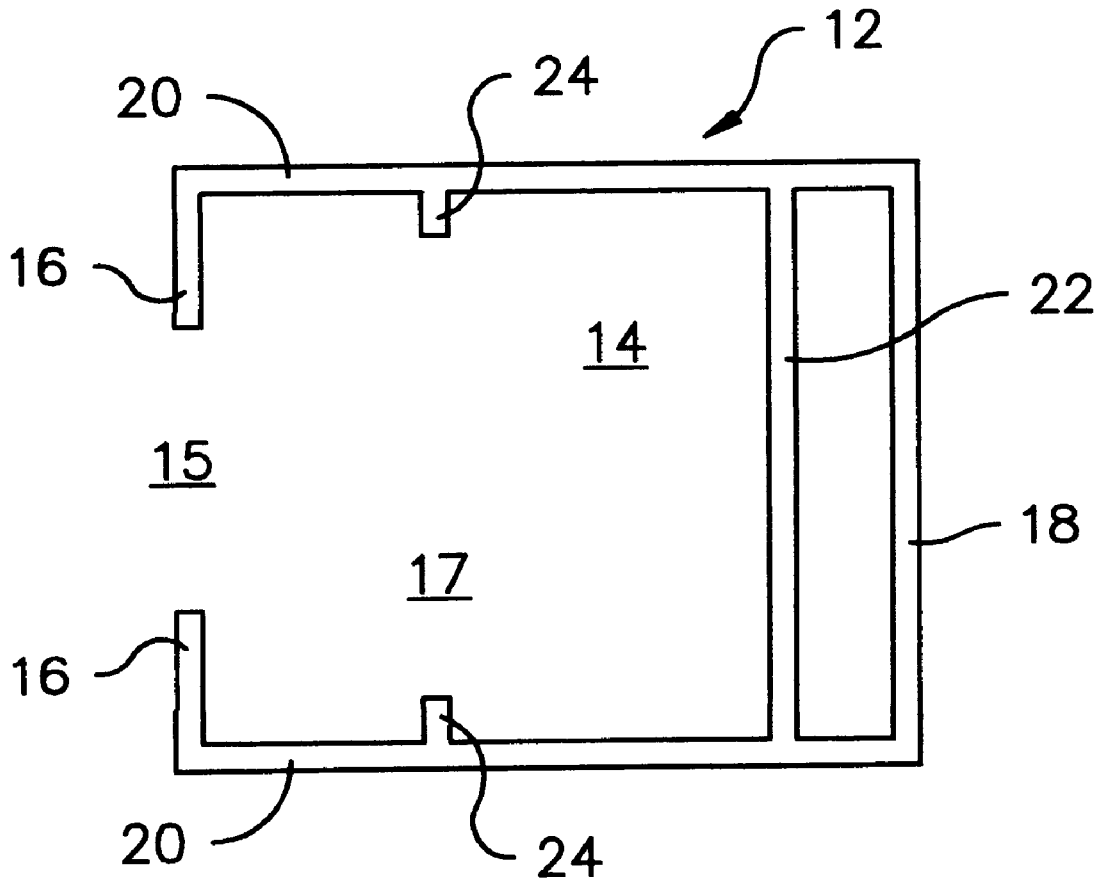
FIG. 4 is a sectional view of an alternate embodiment of a member that may be used to form the periphery of the frames of FIG. 1.
Figure 5:
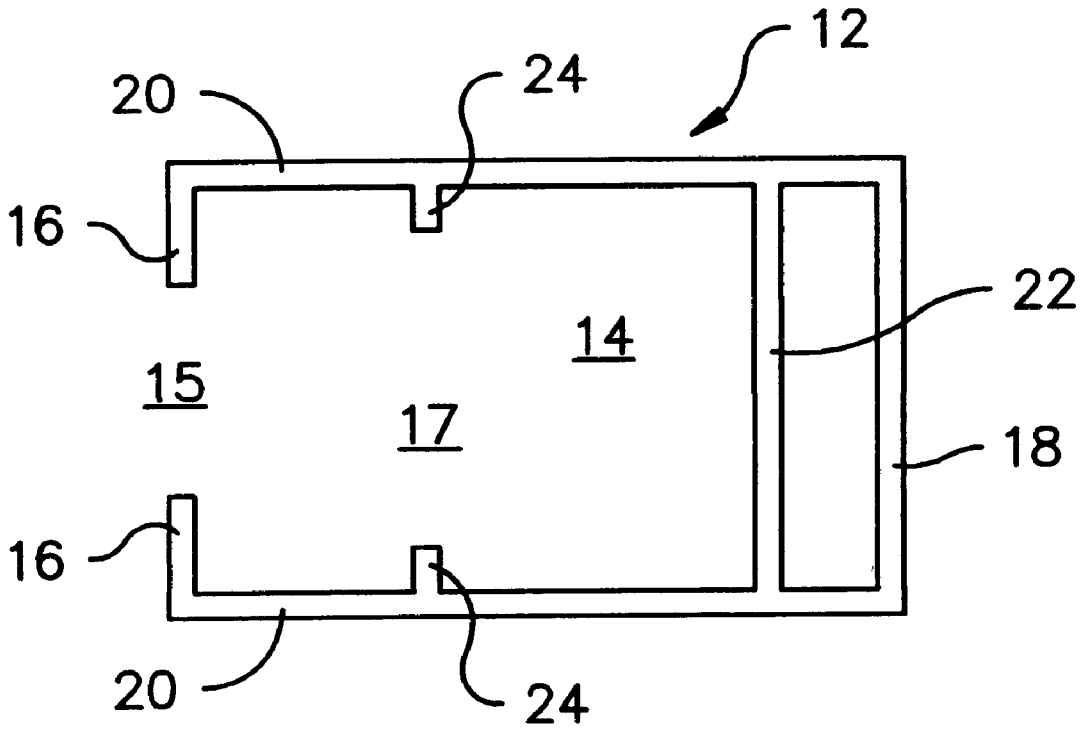
FIG. 5 is a sectional view of a second alternate embodiment of a member used to form the periphery of the frames of FIG. 1.
Figure 6:
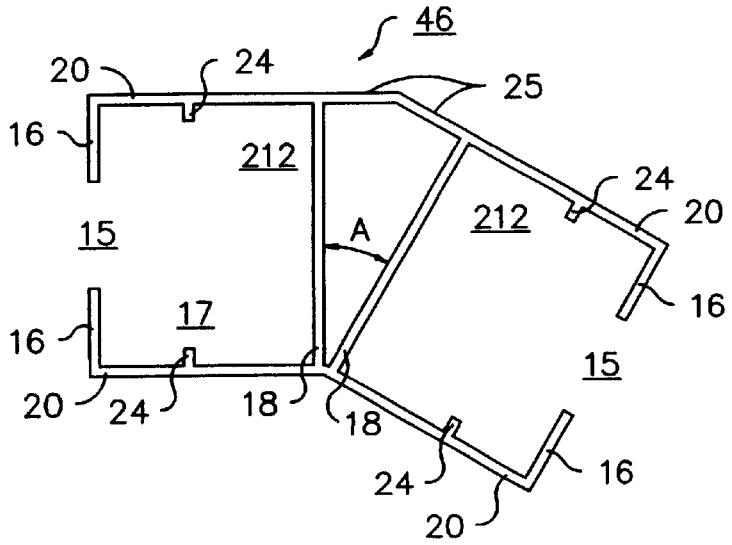
FIG. 6 is a sectional view of an alternate corner member of the type illustrated in FIG. 1 used to connect adjacent frames one to another at an angle of 30°.
Figure 7:
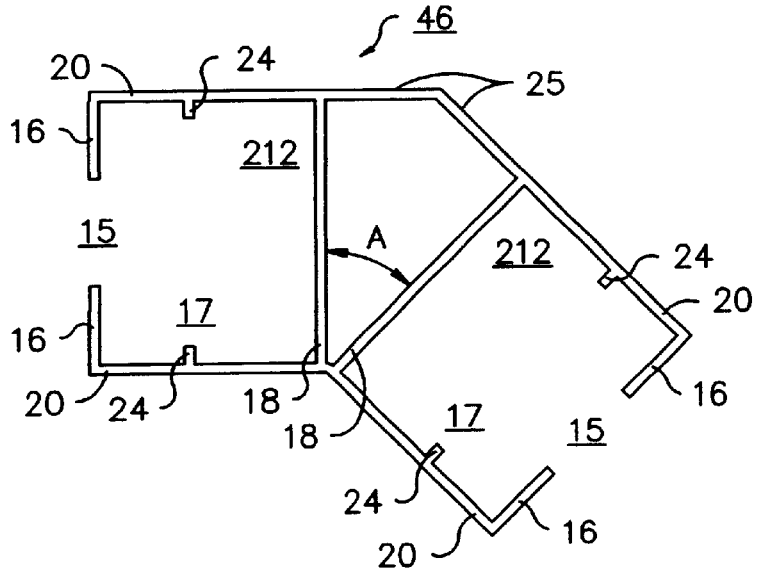
FIG. 7 is a sectional view of an alternate corner member of the type illustrated in FIG. 1 used to connect adjacent frames one to another at an angle of 45°.
Figure 8:
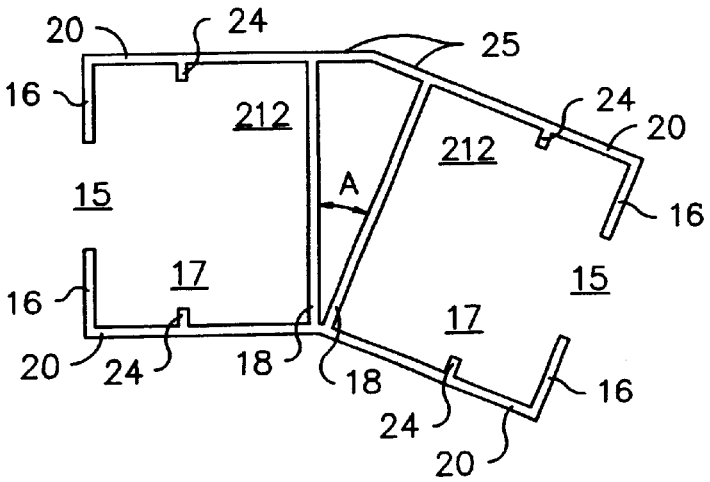
FIG. 8 is a sectional view of an alternate corner member of the type illustrated in FIG. 1 used to connect adjacent frames one to another at an angle of 22.5°.
Figure 9:
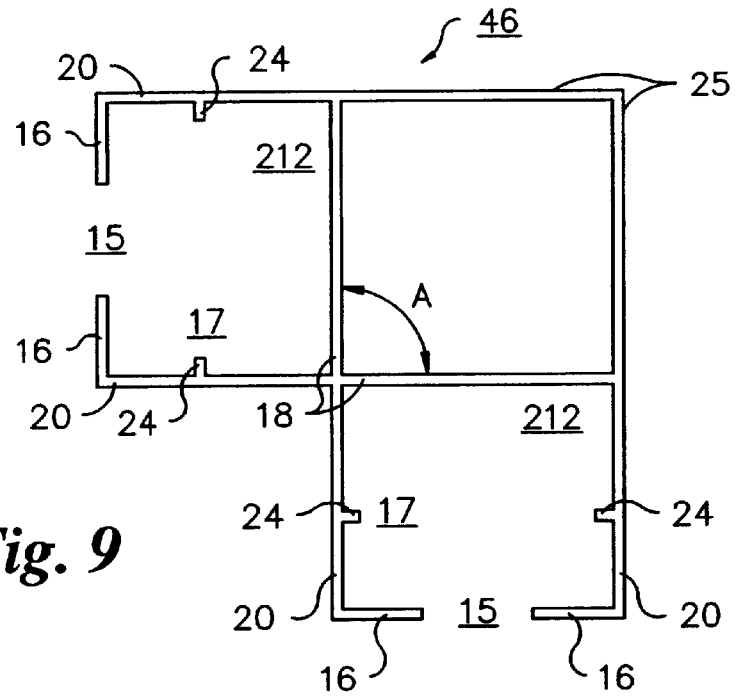
FIG. 9 is a sectional view of an alternate corner member of the type illustrated in FIG. 1 used to connect adjacent frames one to another at an angle of 90°.

FIGS. 4 and 5 depict a sectional view of alternative embodiments of the peripheral member 12 having differing rectangular shapes, and wherein like elements are numbered alike.

Referring now to FIGS. 6–9, sectional views of four embodiments of corner member 46, of the type illustrated in FIG. 1, are shown. The corner member 46 comprises a pair of parallel longitudinally elongated peripheral units 212. The peripheral units 212 are similar in cross-section to peripheral member 12. Each peripheral unit 212 comprises a pair of elongated co-planar first exterior walls 16 separated one from another in a first transverse direction. The separation defines a first longitudinally extending open channel 15, which is open at respective ends of the members prior to assembly of the peripheral members one to another. The peripheral units 212 further comprise a second exterior wall 18 parallel with the first exterior walls 16 and spaced therefrom in a second transverse direction. The peripheral units 212 yet further comprise a parallel pair of third exterior walls 20 connecting respective ones of the first exterior walls 16 with the second exterior wall 18. First, second, and third walls 16, 18, 20 form a generally rectangular shape enclosing a hollow interior (unnumbered) of the peripheral units 212.

The peripheral units 212 still further comprise a pair of longitudinally elongated coplanar guide members 24 separated one from another in the first transverse direction along their longitudinal length. The guide members 24 are parallel with the first exterior walls 16 and are disposed between the first exterior walls 16 and the second exterior wall 18. The separation between the guide members 24 defines a second longitudinally extending open channel 17.

The peripheral units 212 are connected along their longitudinal length of juncture of their second wall 18 with one of their third walls 20 define in interior angle: "A". The angle "A" for FIGS. 6, 7, 8, and 9 is 30°, 45°, 22.5°, and 90°, respectively. Intersecting members 25 each extends in coplanar disposition from respective remaining third walls 20 of the peripheral units 212 at the juncture of the remaining third walls 20 with the second wall 18 which form the vertex of interior angle "A". The said second walls of the peripheral units 212 and said intersecting members 25 define an open ended longitudinally extending transversely closed hollow interior (unnumbered) between the peripheral units 212.

Figure 10:
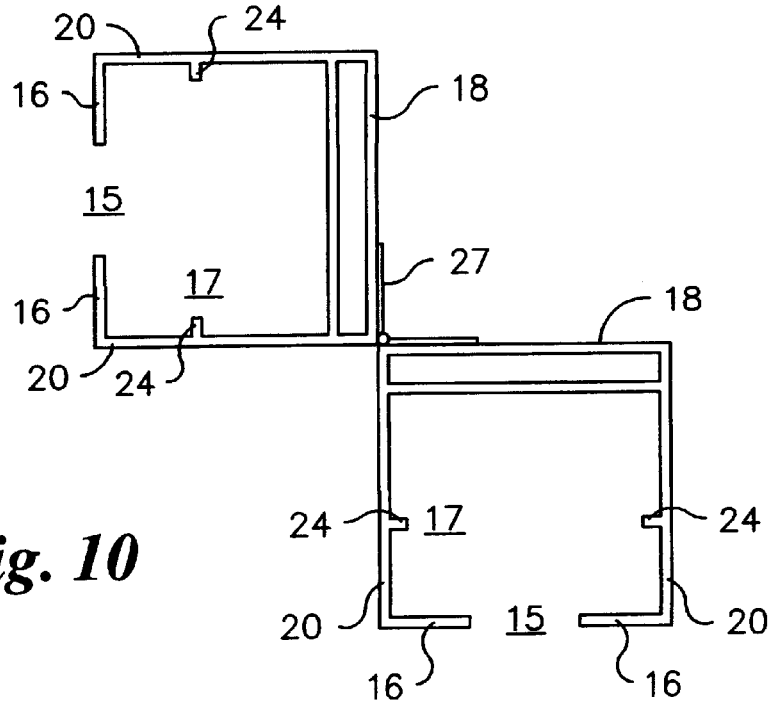
FIG. 10 is a sectional view of a hinged peripheral member used to connect adjacent frames one to another in the manner illustrated generally in FIG. 1.

An alternate method for attaching is depicted in FIG. 10, where a hinge member 27 mounts to second wall 18 of peripheral members 12 at a juncture of second wall 18 and a third wall 20. Attachment of the hinge member is accomplished by screws, bolts, or like fasteners. Alternately, the hinge member may be permanently mounted to the peripheral members by welding. The use of the hinge member 27 obviates the need for the corner member 46.

Figure 12:
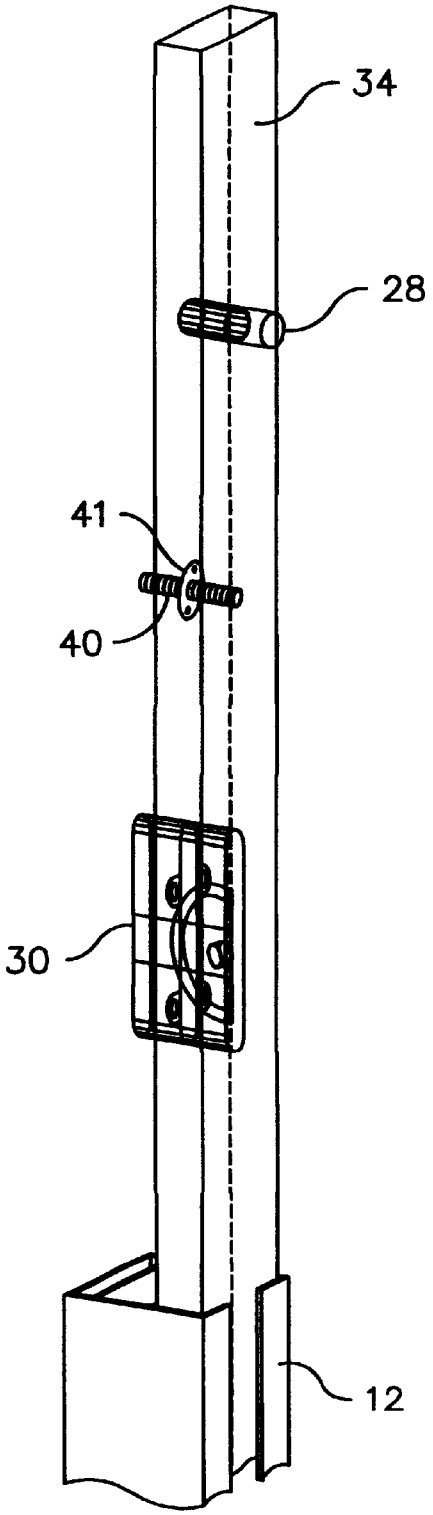
FIG. 12 is an isometric schematic view of an insert filler having a frame fastener latching member secured thereto fitting into a peripheral member of the type illustrated in FIGS. 3, 4 and 5.
Figure 13:
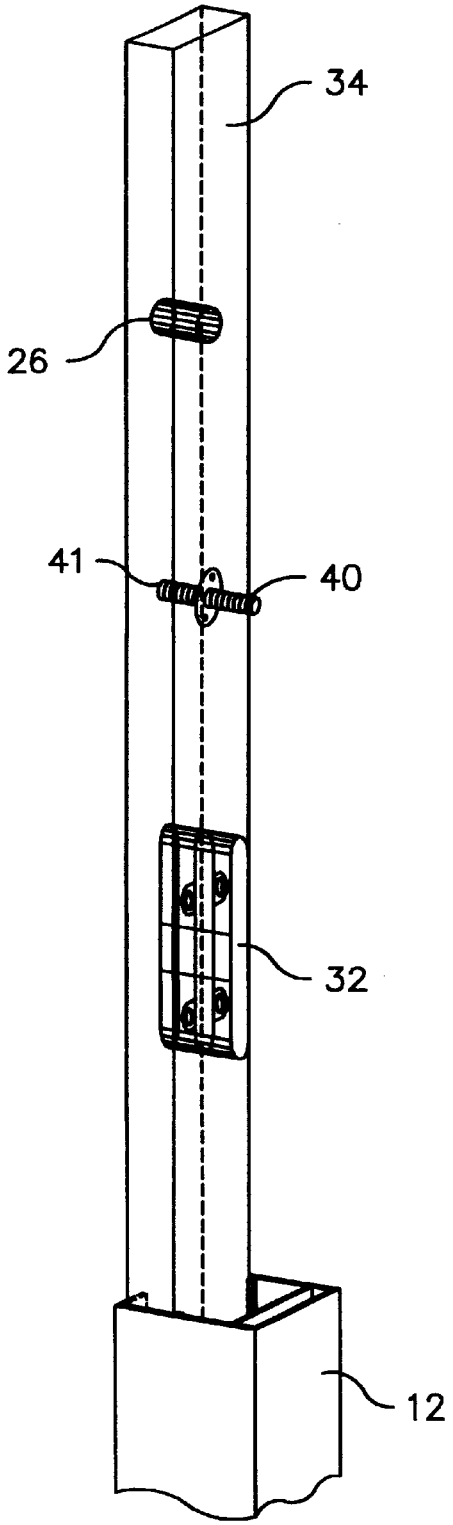
FIG. 13 is an isometric schematic view of an insert filler having a frame fastener receptacle member secured thereto fitting into a peripheral member of the type illustrated in FIGS. 3, 4 and 5.

The manner in which peripheral members 12 and corner members 46 are assembled to form the completed modular locking panel system is depicted schematically in FIGS. 12–20. FIGS. 12 and 13 are isometric views of insert filler 34 inserted into a peripheral member 12. The insert filler 34 is located in the hollow interior 14 of peripheral member 12 between the guide channels 24 and first exterior wall 16, which is more clearly seen in FIGS. 21–24. While the insert fillers 34 of FIGS. 12 and 13 are shown inserted in peripheral members 12 of the type shown in FIGS. 3–5, the insert fillers 34 could be inserted in the peripheral units 212 of the corner members 46 shown in FIGS. 6–9.

The insert filler 34 is fastened to the peripheral member 12, 212 by socket set screw 40. Referring to FIGS. 14, 15 and 21–26, the set screw 40 is retained in insert filler 34 by T-nut 41 and extends outwardly through the second channel 17 and engages the interior wall 22 of peripheral members 12, or alternately engages the second wall 18 of peripheral unit 212. The set screw 40 biases the insert filler 34 frictionally against the first exterior wall 16 of the peripheral member 12, 212, thus securely affixing the insert filler 34 to the peripheral member 12, 212.

Figure 21:
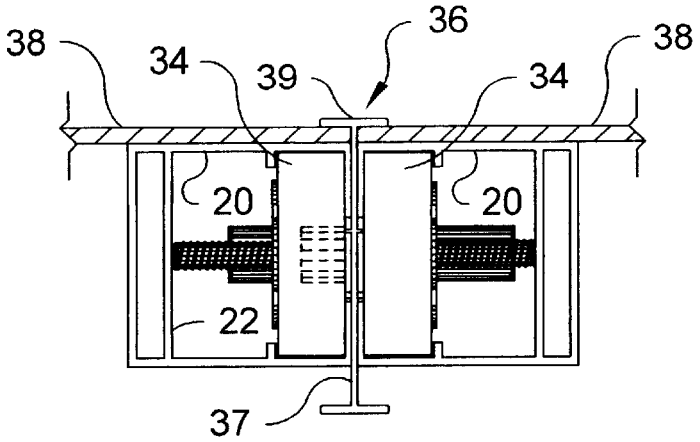
FIG. 21 is a sectional view of a pair of peripheral members of the type illustrated in FIGS. 3, 4 and 5 with an overlay holder member secured in position therebetween, inserts in position in each of the peripheral members and an overlay skin held in position by the overlay holder member.
Figure 22:
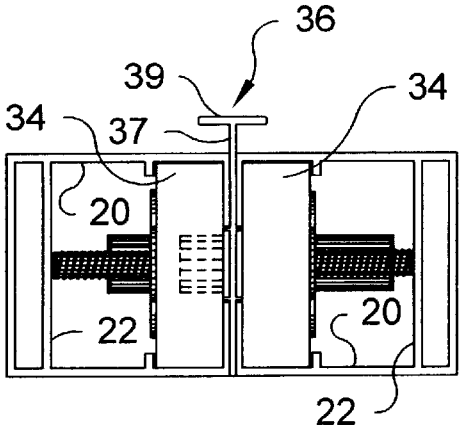
FIG. 22 is a sectional view similar to FIG. 21 but in which the overlay holder is adapted to hold overlay skin on only a single side of the peripheral members.
Figure 23:
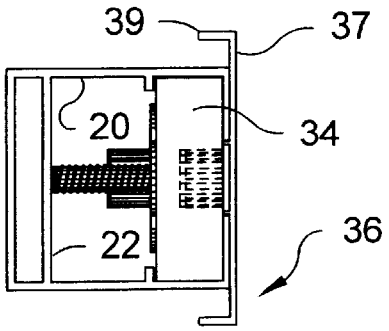
FIG. 23 is a sectional view of a single peripheral member, similar to FIGS. 21 and 22 with an overlay holder in place and configured to retain overlay skins on two sides of the peripheral member.
Figure 24:
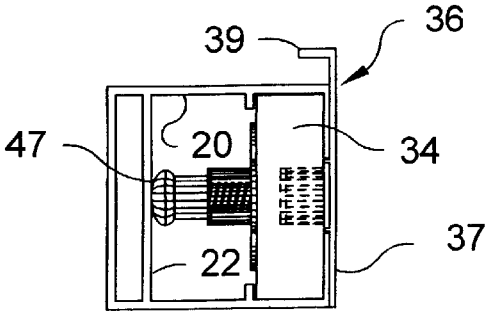
FIG. 24 is a sectional view of a single peripheral member, similar to FIGS. 21 and 22 with an overlay holder in place and configured to retain overlay skins on one side of the peripheral member.
Figure 25:
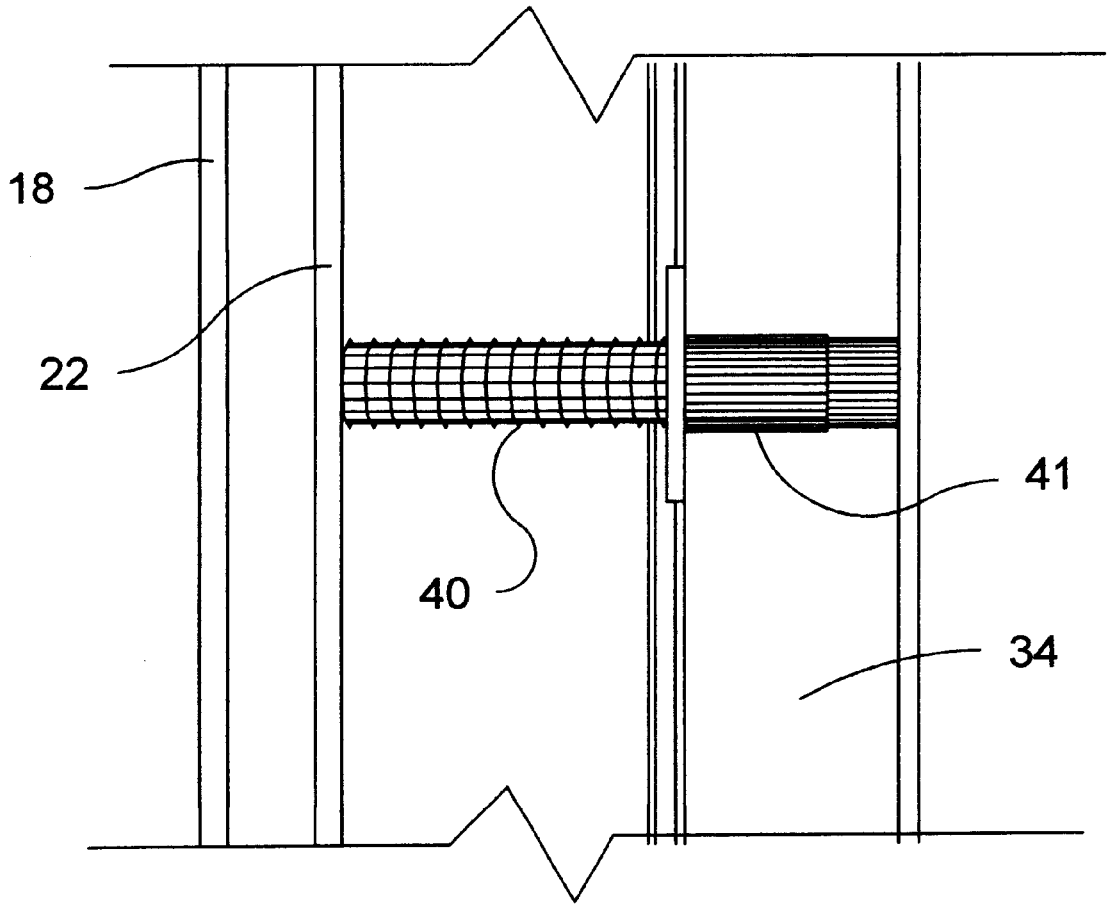
FIG. 25 is a side view of an insert pressure device mounted in a peripheral member of the type illustrated in FIGS. 3, 4, and 5.
Figure 26:
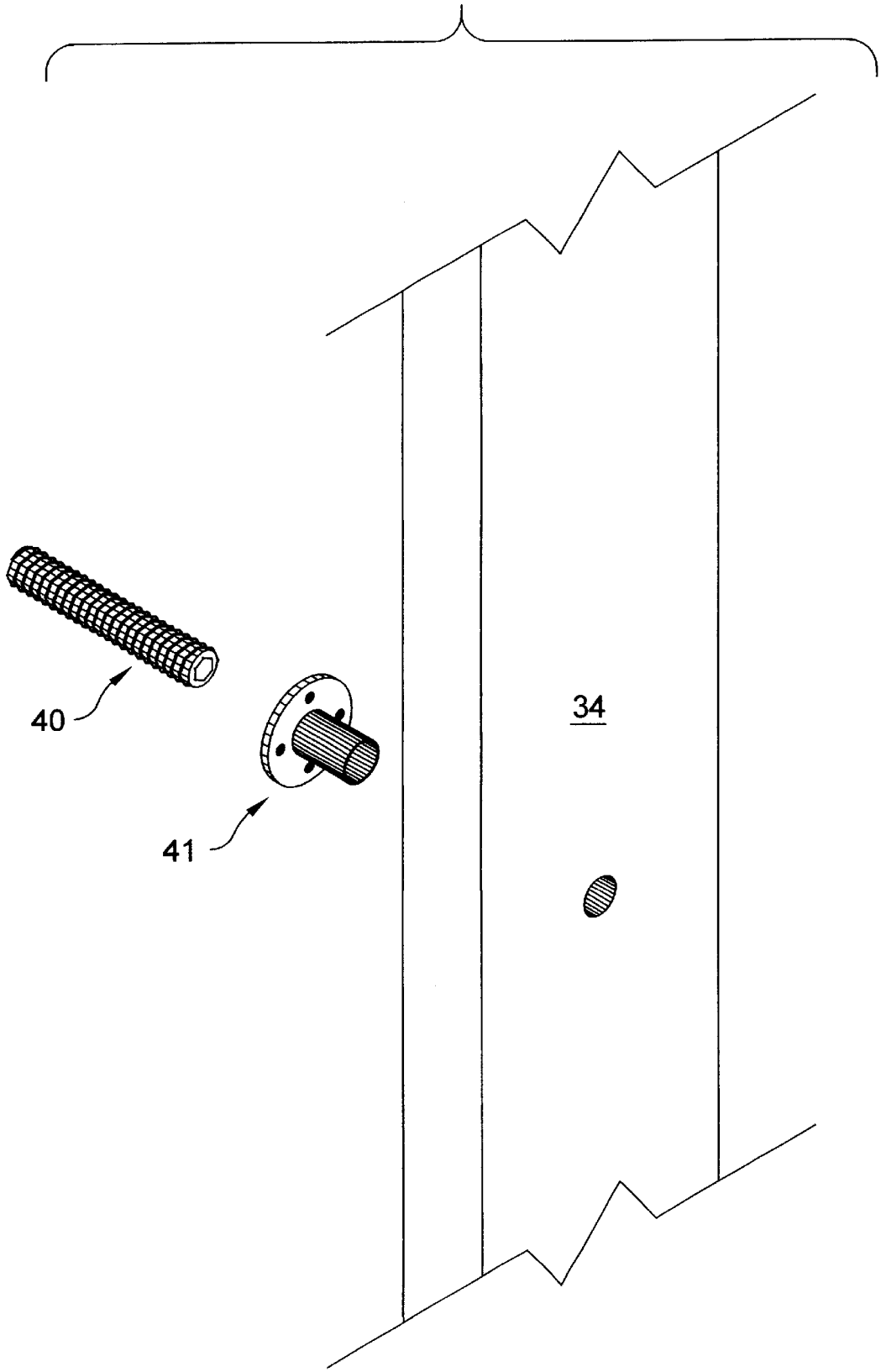
FIG. 26 is an exploded schematic isometric view of the insert pressure device illustrated in FIG. 25.
Figure 27:
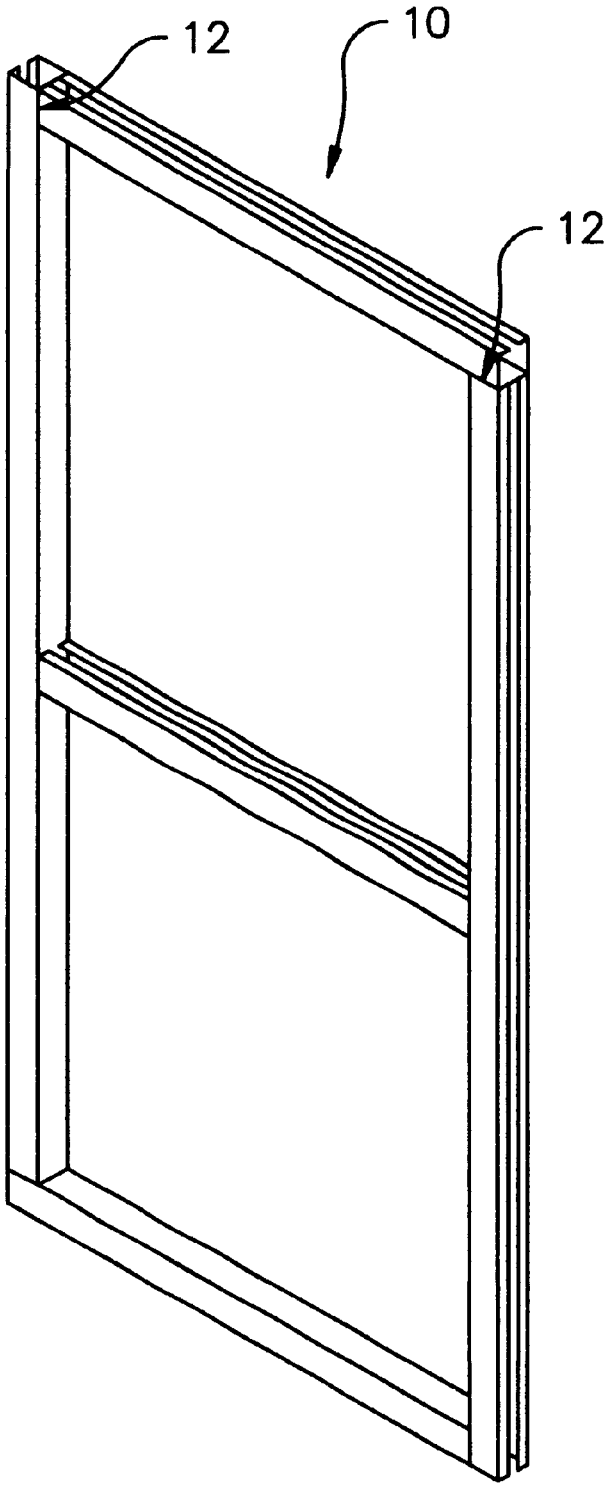
FIG. 27 is an isometric view of a rectangular frame, of the type illustrated generally in FIG. 1, assembled from peripheral members of the type illustrated in FIGS. 3, 4, and 5.

As shown in FIGS. 21–23, the set screw 40 abuts the interior wall 22. Alternatively, the set screw 40 can be capped with a rubber tip 47, as shown in FIG. 24. The use of a rubber cap 47 is not necessary, and can be used by operator preference in any embodiment.

Figure 16:
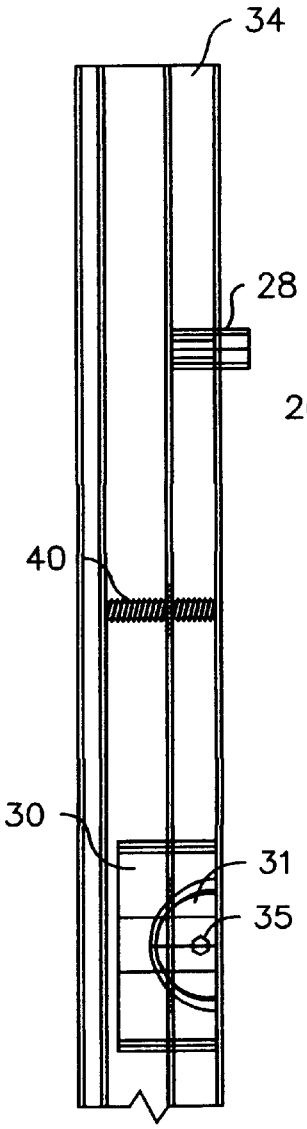
FIG. 16 is a schematic side elevation of a peripheral member of the type illustrated in FIGS. 3, 4 and 5 with an insert filler together with a fastener insert member and a frame fastener latching member illustrated in place.
Figure 17:
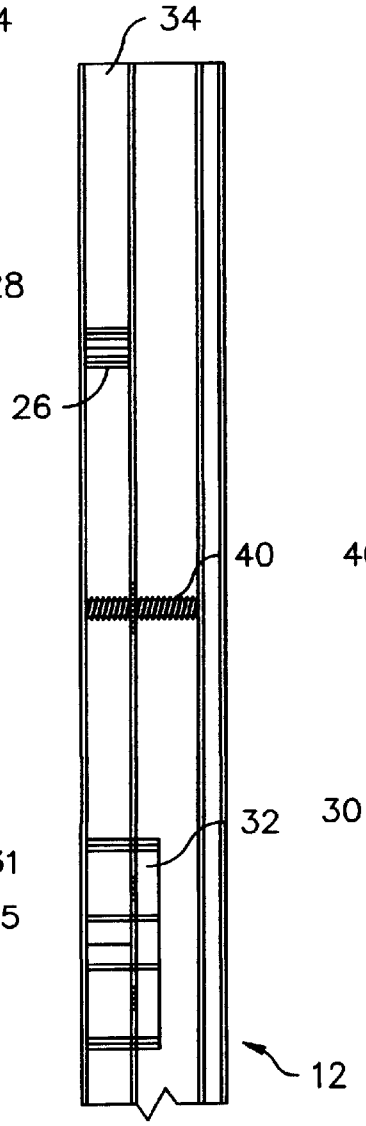
FIG. 17 is a schematic side elevation of a peripheral member of the type illustrated in FIGS. 3, 4 and 5 with an insert filler together with a fastener insert member and a frame fastener receptacle member illustrated in place.
Figure 18:
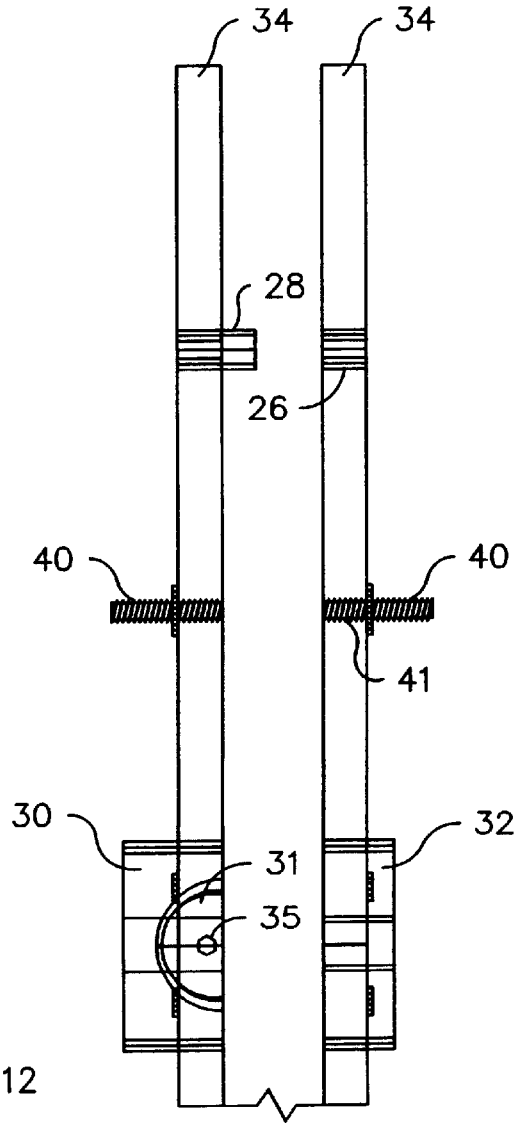
FIG. 18 is a side view of the inserts illustrated in FIGS. 16 and 17.
Figure 15:
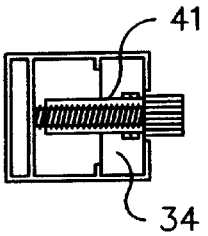
FIG. 15 is a schematic sectional view of a peripheral member of the type illustrated in FIGS. 3, 4 and 5 with a fastener insert member illustrated in place.
Figure 14:
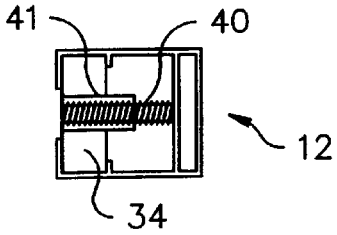
FIG. 14 is a schematic sectional view of a peripheral member of the type illustrated in FIGS. 3, 4 and 5 with a fastener receptacle member illustrated in place.
Figure 19:
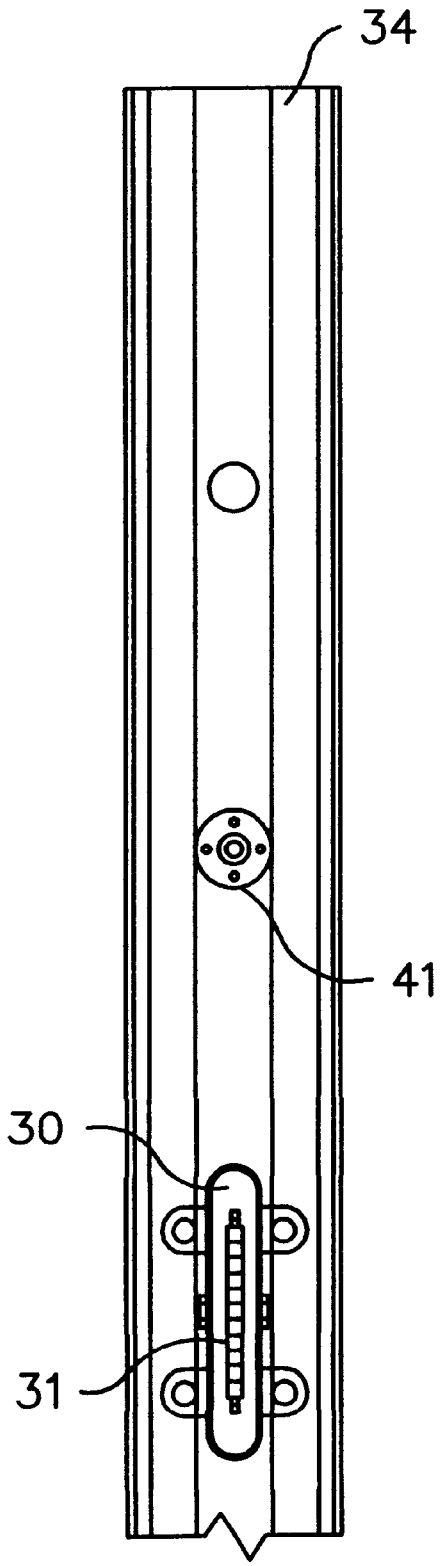
FIG. 19 is a front view of the insert illustrated in FIG. 16.
Figure 20:
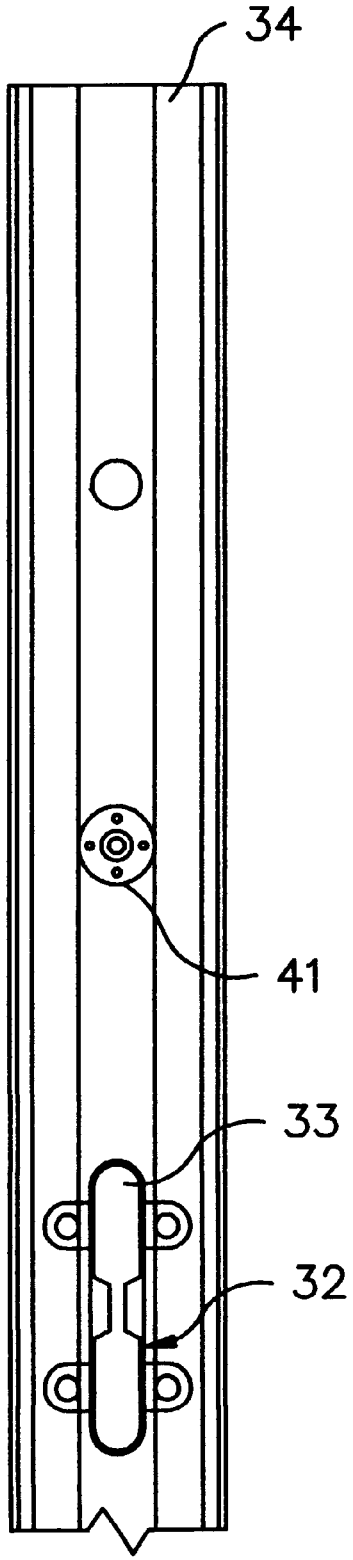
FIG. 20 is a front view of the insert illustrated in FIG. 17.

The insert filler 34 of FIGS. 12, 16, and 19 further comprises a frame fastener latching member 30, while the insert filler 34 of FIGS. 13, 17, and 20 comprises a frame fastener latching receptacle member 32.

As seen in FIGS. 21 and 22, the latching member 30 and latching receptacle member 32 engage in interlocking relationship to fasten the respective insert fillers 34. In another embodiment, the latching member 30 comprises a locking arm 31 that rotates about an axis, perpendicular to the plane of the drawing, of locking arm key member 35. Key member 35 may be a socket, such as a socket for a hex-key or screwdriver, may be a pin, such as a pin for a hex driver, or may be a similar device known in the art. The locking arm 31 is rotated by turning the key member 35, whereby locking arm 31 slides into locking arm receptacle 33 of latch receptacle member 32.

Further, the insert filler 34 of FIGS. 12, 16, and 19 comprises alignment member 28, while the insert filler 34 of FIGS. 13, 17 and 20 comprises an alignment aperture 26. Alignment member 28 mates into alignment aperture 26 to aid in the alignment of the respective insert fillers 34. The interconnection of the respective mating elements 31, 38 of insert filler 34 permit the interconnection of the frames 10 as depicted in the example of FIG. 2.

Figure 11:
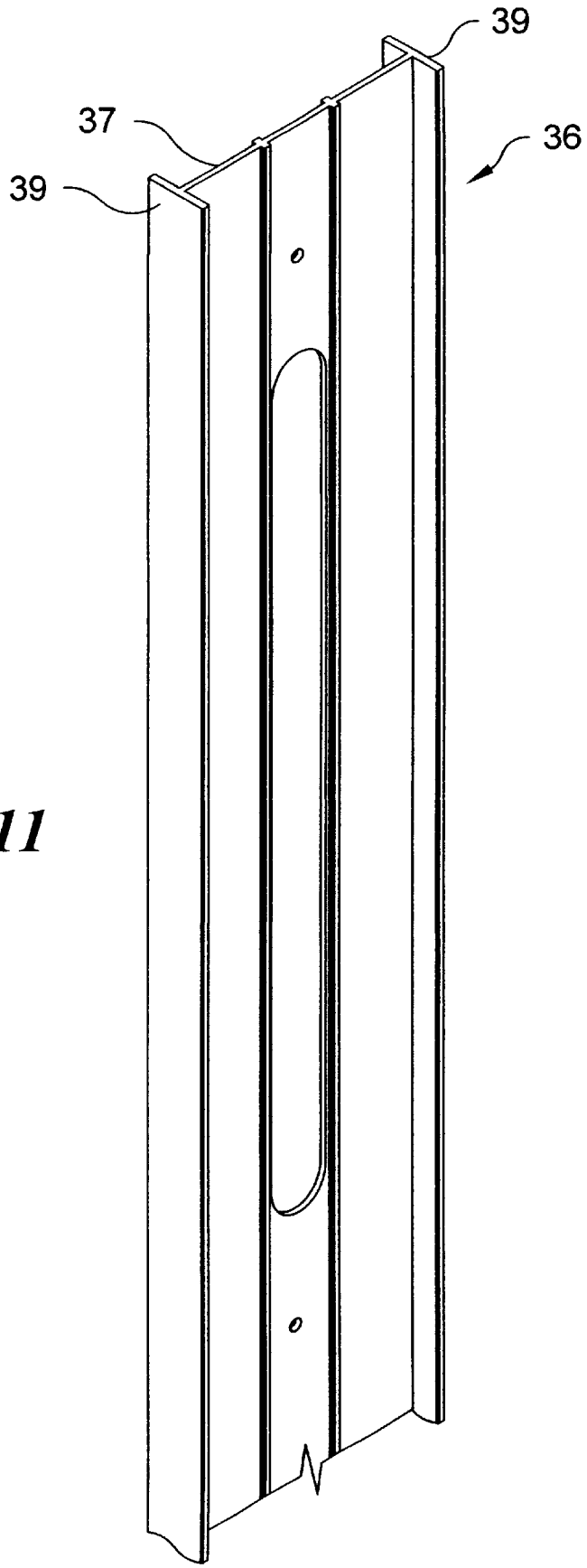
FIG. 11 is an overlay holding member that may be used with the frames illustrated in FIG. 1.

There are various methods for attaching the overlay skins 38 to the panel system 8. A first attachment method uses overlay holder 36, depicted in FIG. 11 and shown inserted within the modular panel locking system assembly of FIGS. 21–24. The overlay holder 36 has a major longitudinally elongated surface 37 that adjoins peripheral member 12 parallel to the second wall 18. The overlay holder 36 also has a tab 39, extending in one or both perpendicular directions from one or both ends of the elongated surface 37. Inserting the overlay skin 38 between the tab 39 and the exterior wall 20 retains the overlay skin 38 to the peripheral member 12.

FIGS. 21–24 depict four embodiments of overlay holder 36. FIG. 21 depicts an overlay holder 36 capable of retaining four overlay skins 38 (two shown). FIG. 22 depicts an overlay holder 36 capable of retaining two overlay skins 38 (not shown) in coplanar orientation. FIG. 23 depicts an overlay holder 36 capable of retaining two overlay skins 38 (not shown) parallel to each other and separated by peripheral member 12. FIG. 24 depicts an overlay holder 36 capable of retaining one overlay skin 38 (not shown).

A second method for attaching the overlay skins 38 to the panel system 8 is by using a double-tabbed overlay holder 42. The double-tabbed overlay holder 42 operates similarly to the overlay holder 36, differing by a second tab 39 extending in one or both perpendicular directions (parallel to the first tab 39) from a point nearing one or both ends of the elongated surface 37.

FIGS. 30–33 depict four embodiments of the double-tabbed overlay holder 42. The double-tabbed overlay holder 42 allows for the attachment of the overlay skin 38 to the frames 10 while providing a small gap between the overlay skin 38 and the exterior wall 20 of the peripheral member 12. The small gap can be filled with an additional Velcro-type fastener.

Figure 34:
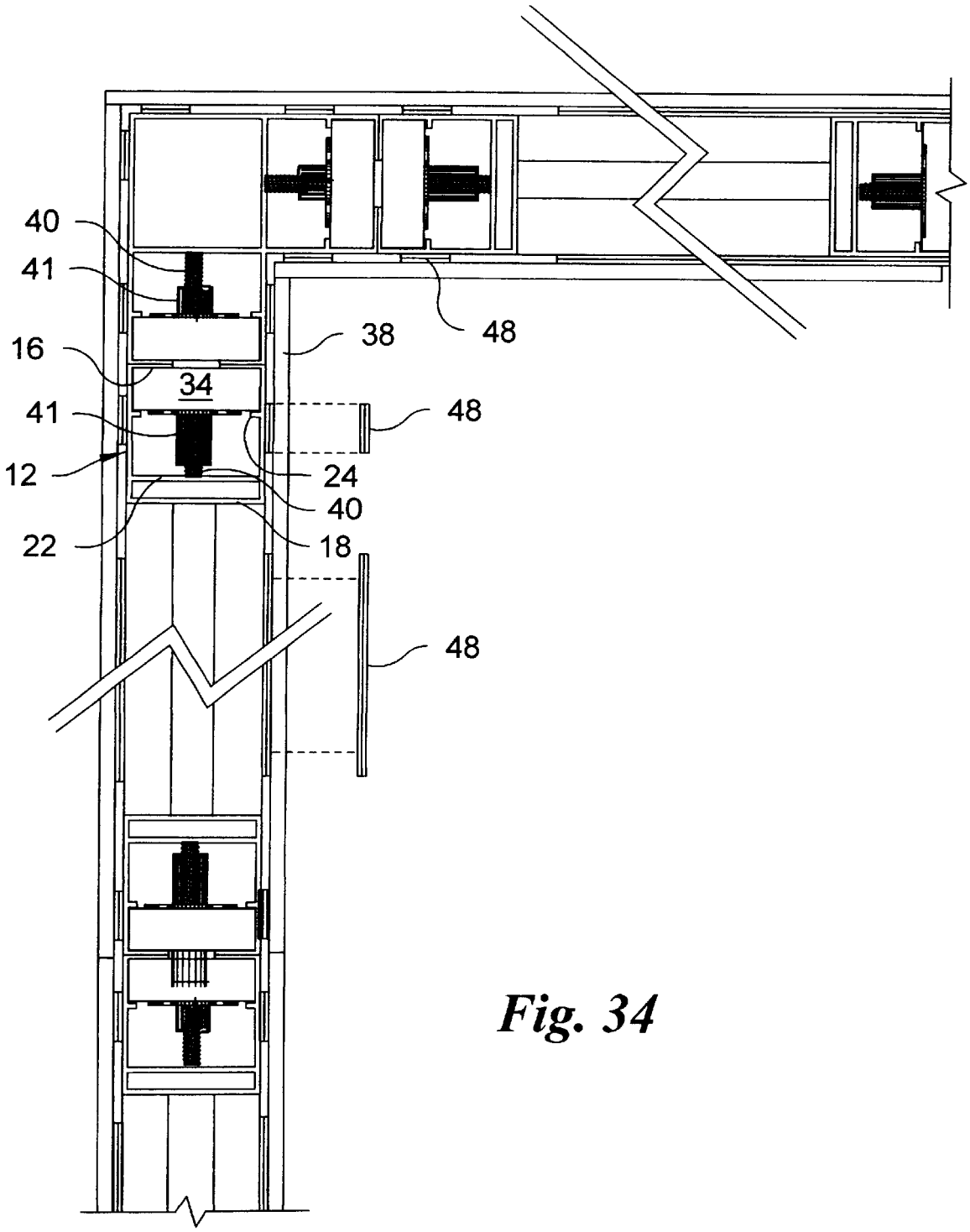
FIG. 34 is a plan view of a modular locking panel system with the overlay skins attached to the peripheral members, corner members, and frames by a Velcro or similar attachment system.
Figure 35:
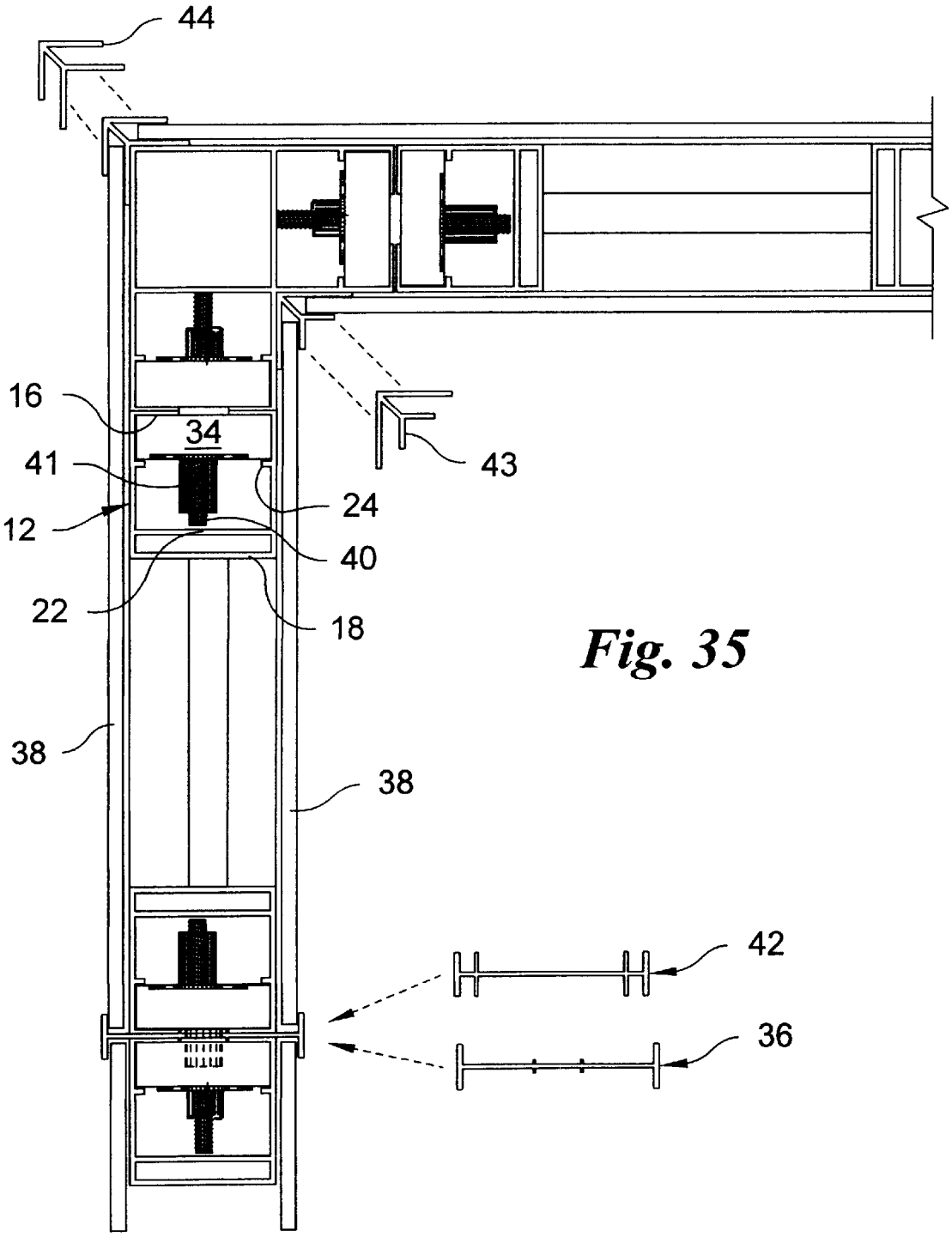
FIG. 35 is a plan view of the modular locking panel system with the overlay skins attached to the corner members with corner holders.

A third method for attaching the overlay skins 38 to the panel system 8 is by using Velcro 48, or similar type fastener, between the overlay skin 38 and the frames 10, the peripheral members 12, and the corner peripheral members 46. FIG. 34 illustrates the attachment of the overlay skins 38 to the system 8 exclusively by Velcro-type fasteners 48. Alternatively, FIG. 34 could additionally include a double-tabbed overlay holder 42 between any or all of the adjoining pairs of peripheral members 12.

Figure 36:
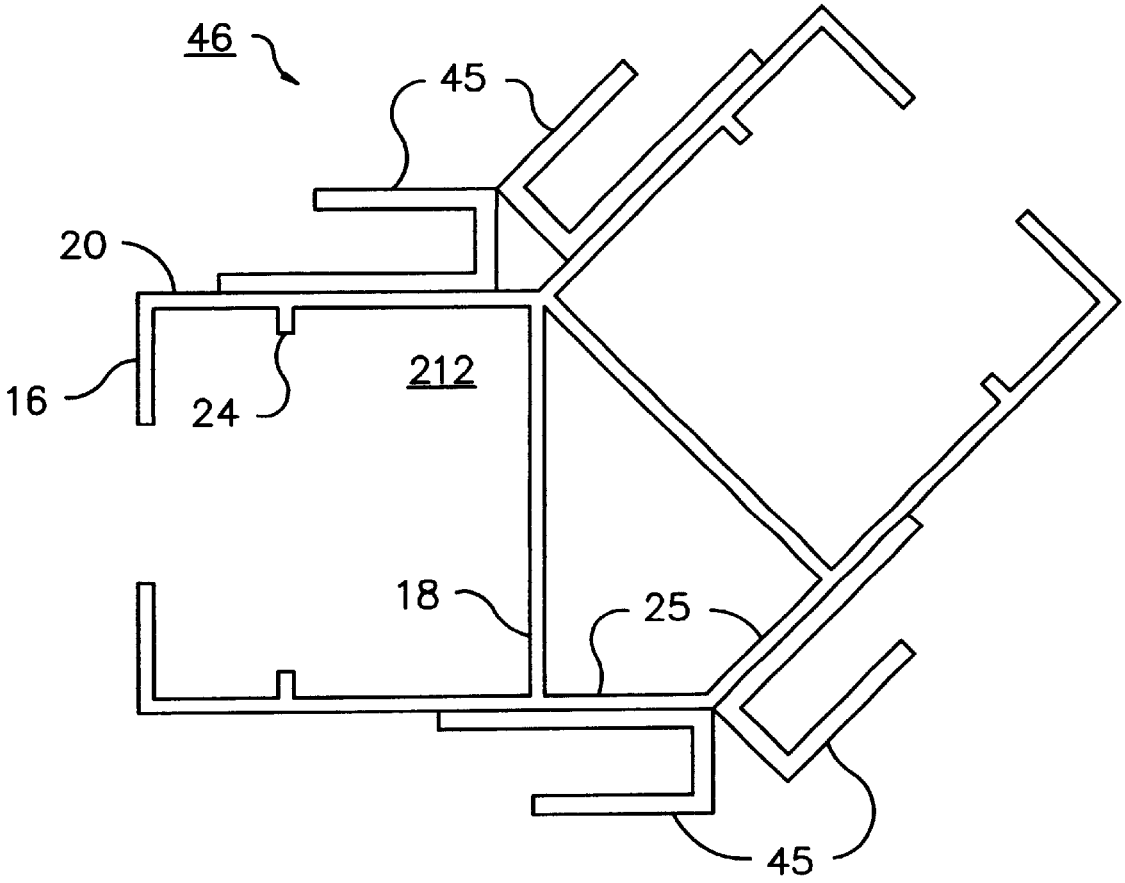
FIG. 36 is a plan view of overlay skin retainers attached to corner members, in accordance with the present invention.

A fourth method for attaching the overlay skins 38 to the panel system 8 is by using the overlay holder 36, or the double-tabbed overlay holder 42, in conjunction with corner holders 43, 44. An inside corner holder 43 and an outside corner holder 44 each serve 90° corners and can be screwed, welded, or adhered with high strength glue or double-stick tape to the corner member 46. A fifth method for attaching the overlay skins 38 to the panel system 8 is by using overlay skin retainers 45, as illustrated in FIG. 36. Especially useful at the corner members 46, the retainers 45 can be used at any location along the panel system 8. The retainers 45 are configured in left-hand and right-hand arrangement, with a longest edge being screwed, welded, or adhered with high strength glue or double-stick tape to the corner member 46, the peripheral member 12, or the frame 10.

Figure 28:
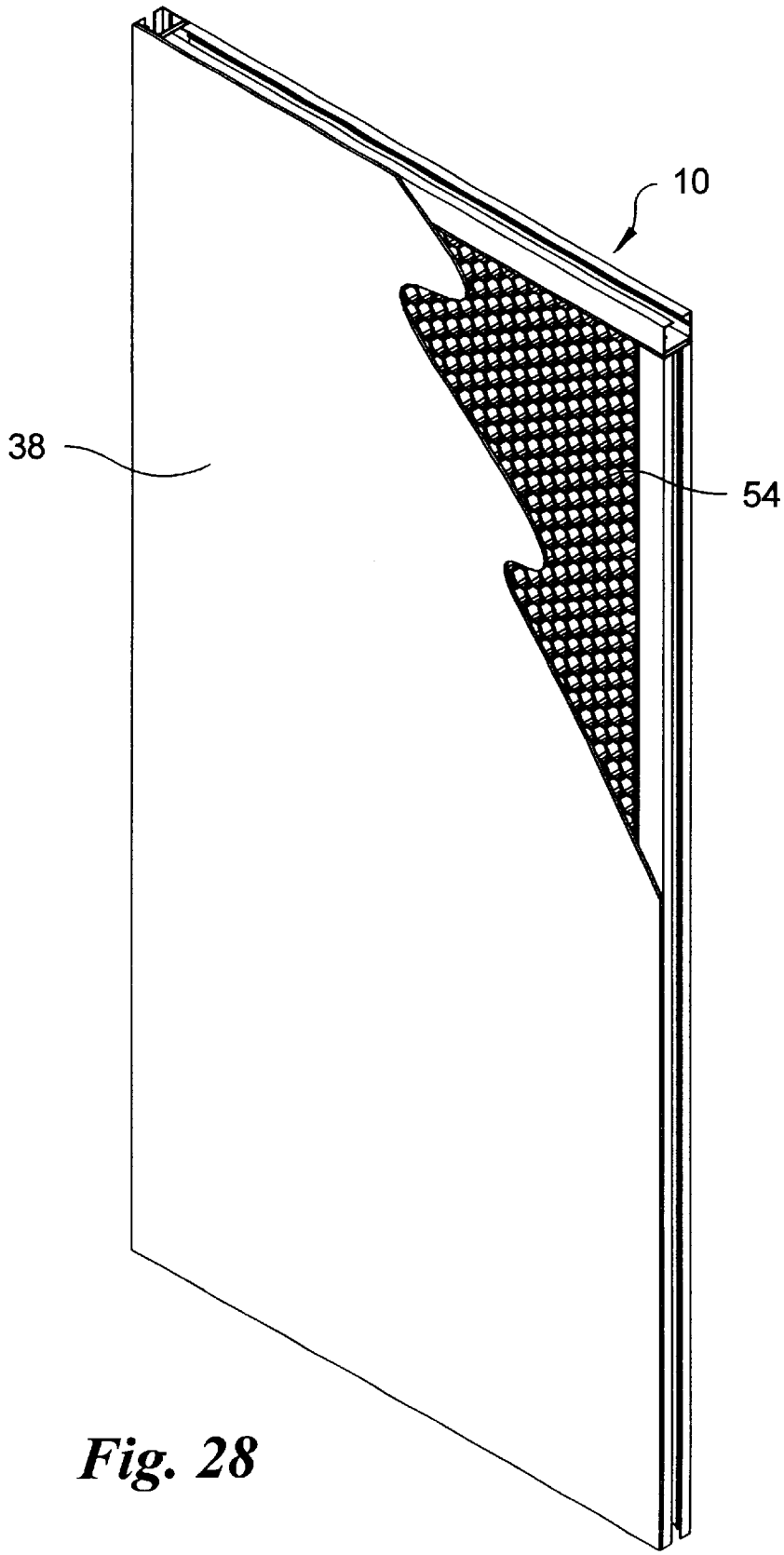
FIG. 28 is a schematic isometric view of the frame of FIG. 27 with a permanent overlay skin attached thereto and honeycomb filler material in the interior of the frame.
Figure 29:
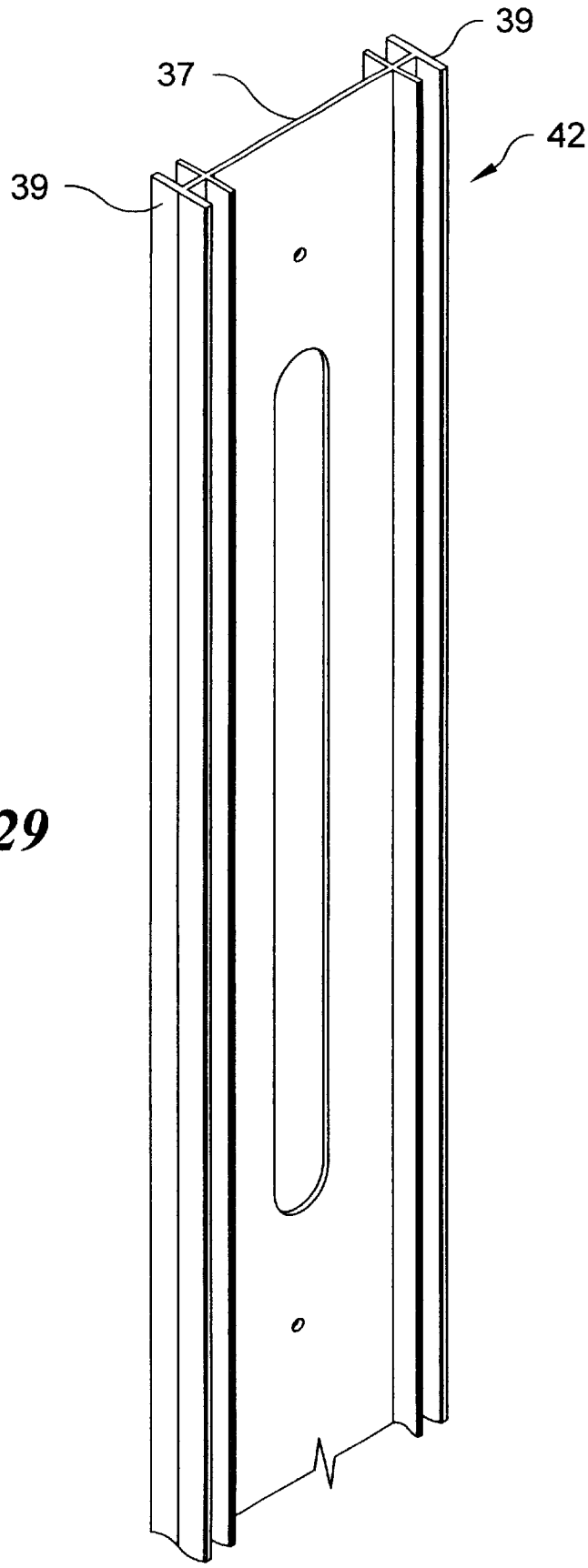
FIG. 29 is a schematic isometric view of an overlay skin holder.
Figure 30:
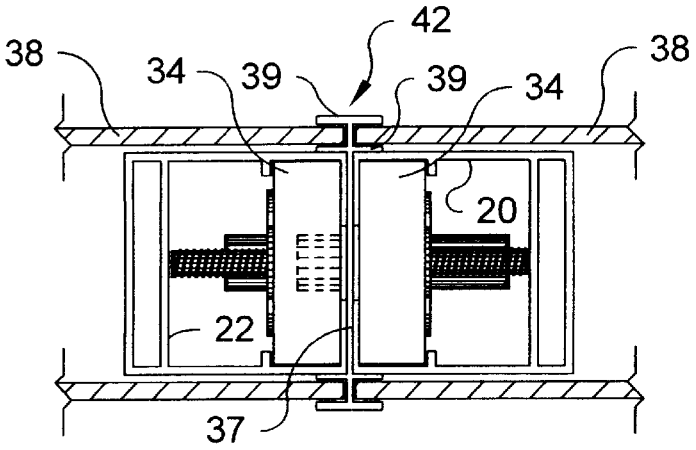
FIG. 30 is a sectional view of a pair of peripheral members of the type illustrated in FIGS. 3, 4 and 5 with a double-tabbed overlay holder secured therebetween and insert fillers within each of the peripheral members and four overlay skins held in position by the double-tabbed overlay holder.
Figure 31:
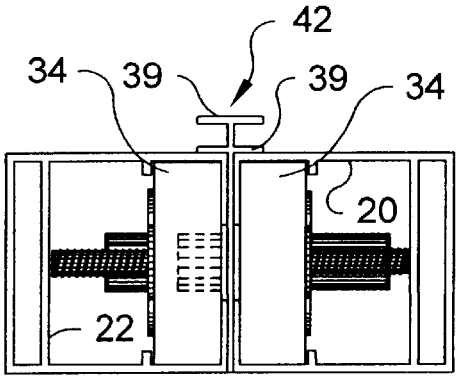
FIG. 31 is a sectional view similar to FIG. 30 except the double-tabbed overlay holder is adapted to hold overlay skins on only a single side of the peripheral members.
Figure 32:
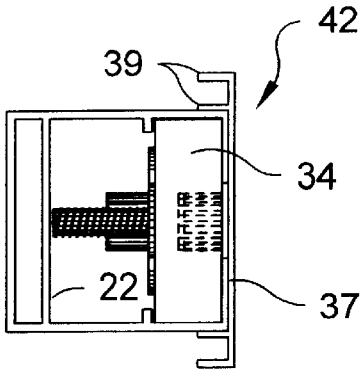
FIG. 32 is a sectional view of a single peripheral member with a double-tabbed overlay holder in place and configured to retain one overlay skin on each side of the peripheral member.
Figure 33:
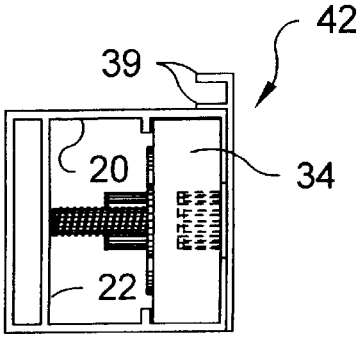
FIG. 33 is a sectional view of a single peripheral member with a double-tabbed overlay holder in place and configured to retain one overlay skin on one side of the peripheral member.

The above noted methods for attaching the overlay skins 38 to the panel system 8 can be selectively combined to form a multitude of various attachment configurations. The interior of the frame 10 can be filled with a honeycomb material 54, as shown in FIG. 28.

These and other advantages of the present invention will be apparent to those skilled in the art from the foregoing specification. Accordingly, it will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention.

What is claimed is:

1. A modular exhibit assembly adapted for rapid set up and teardown, comprising:

a. a plurality of rectangular frames, each adapted for supporting a display in a generally vertical plane and comprising:

i. a plurality of longitudinally elongated peripheral members, each having a hollow interior extending the longitudinal length of the member and comprising:

1) a pair of longitudinally elongated parallel and coplanar first exterior walls separated, one from another in a first transverse direction along their longitudinal length, such separation defining a first longitudinally extending open channel, said first channels being open at respective ends of said members prior to assembly of said members one to another;

2) a second exterior wall parallel with said first exterior walls and spaced therefrom in a second transverse direction;

3) a parallel pair of third exterior walls connecting respective ones of said first exterior walls with said second exterior wall to define a generally rectangular periphery of said member;

ii. said members being connected together and defining a generally rectangular shape for said frame, with on end of each elongated member abutting the second exterior wall of an adjacent member, with the hollow interior of the member being open at said remaining end, with said open channel facing outwardly respecting said rectangular shape of said frame wherein the longitudinally elongated members further comprise a pair of longitudinally elongated coplanar guide members separated one from another in the first transverse direction along their longitudinal length, such separation defining second longitudinally extending open channels, the guide members being parallel with said first exterior walls and disposed between said first exterior walls and said exterior wall.

2. The modular exhibit assembly of claim 1, wherein the longitudinally elongated members further comprise a longitudinally elongated interior wall parallel to and disposed between said second exterior wall and said guide members, the interior wall adjoining along its longitudinal length said third exterior walls.

3. The modular exhibit assembly of claim 2, further comprising longitudinally elongated insert fillers insertable into said peripheral members between said first exterior walls and said guide members wherein first said insert fillers have latch members attached thereto, said latch members facing outwardly through said first channels.

4. The modular exhibit assembly of claim 3, wherein second said insert fillers have latch receptacle members attached thereto, said latch receptacle members capable of accepting said latch members.

5. The modular exhibit assembly of claim 2, further comprising longitudinally elongated insert fillers for insertion into said peripheral members between said first exterior walls and said guide members wherein said insert fillers have alignment members attached thereto, said alignment members extending outwardly through said first channels.

6. The modular exhibit assembly of claim 5, wherein second said insert fillers have alignment receptacles formed therein, said alignment receptacles capable of accepting said alignment members.

7. The modular exhibit assembly of claim 2, further comprising longitudinally elongated insert fillers for insertion into said peripheral members between said first exterior walls and said guide members wherein said insert fillers have set screws attached thereto, said set screws extending inwardly through said second channels and engaging said interior walls, the set screws biasing said insert fillers frictionally against said first exterior walls.

8. An apparatus-for fixedly connecting a pair of rectangular frames which are adapted for rapid. set up and breakdown, comprising:

a. a pair of parallel longitudinally elongated peripheral members, each comprising:

i. a pair of longitudinally elongated parallel and coplanar first exterior walls separated one from another in a first transverse direction along their longitudinal length, such separation defining a longitudinally extending open channel, said channels being open at respective ends of said members prior to assembly of said members one to another;

ii. a second exterior wall parallel with said first exterior walls and spaced therefrom in a second transverse direction;

iii. a parallel pair of third exterior walls connecting respective ones of said first exterior walls with said second exterior wall to define a generally rectangular periphery of said member;

b. said peripheral members being connected along a longitudinal length of juncture of a second wall with one of a third wall; and c. intersecting members each extending in coplanar disposition from respective remaining third walls of said peripheral members at juncture of said remaining third walls with said second wall; said second walls of said peripheral members and said intersecting members defining and open ended longitudinally extending transversely closed hollow interior between said peripheral members wherein the longitudinally elongated members further comprise a longitudinally elongated interior wall parallel to and disposed between said second exterior wall and said guide members, the interior wall adjoining along its longitudinal length said third exterior walls further comprising longitudinally elongated insert fillers for insertion into said peripheral members between said first exterior walls and said guide members wherein first said insert fillers have latch members attached thereto, said latch members facing outwardly through said first channels.

9. The apparatus of claim 8, wherein second said insert fillers have latch receptacle members attached thereto, said latch receptacle members capable of accepting said latch members.

10. An apparatus for fixedly connecting a pair of rectangular frames which are adapted for rapid set up and breakdown, comprising:

a. a pair of parallel longitudinally elongated peripheral members, each comprising:

i. a pair of longitudinally elongated parallel and coplanar first exterior walls separated one from another in a first transverse direction along their longitudinal length, such separation defining a longitudinally extending open channel, said channels being open at respective ends of said members prior to assembly of said members one to another;

ii. a second exterior wall parallel with said first exterior walls and spaced therefrom in a second transverse direction;

iii. a parallel pair of third exterior walls connecting respective ones of said first exterior walls with said second exterior wall to define a generally rectangular periphery of said member;

b. said peripheral members being connected along a longitudinal length of juncture of a second wall with one of a third wall; and c. intersecting members each extending in coplanar disposition from respective remaining third walls of said peripheral members at juncture of said remaining third walls with said second wall; said second walls of said peripheral members and said intersecting members defining and open ended longitudinally extending transversely closed hollow interior between said peripheral members wherein the longitudinally elongated members further comprise a longitudinally elongated interior wall parallel to and disposed between said second exterior wall and said guide members, the interior wall adjoining along its longitudinal length said third exterior walls further comprising longitudinally elongated insert fillers for insertion into said peripheral members between said first exterior walls and said guide members wherein first said insert fillers have alignment members attached thereto, said alignment members extending outwardly through said first channels.

11. The apparatus of claim 10, wherein second said insert fillers have alignment receptacles formed therein, said alignment receptacles capable of accepting said alignment members.

12. An apparatus for fixedly connecting a pair of rectangular frames which are adapted for rapid set up and breakdown, comprising:

a. a pair of parallel longitudinally elongated peripheral members, each comprising:

i. a pair of longitudinally elongated parallel and coplanar first exterior walls separated one from another in a first transverse direction along their longitudinal length, such separation defining a longitudinally extending open channel, said channels being open at respective ends of said members prior to assembly of said members one to another;

ii. a second exterior wall parallel with said first exterior walls and spaced therefrom in a second transverse direction;

iii. a parallel pair of third exterior walls connecting respective ones of said first exterior walls with said second exterior wall to define a generally rectangular periphery of said member;

b. said peripheral members being connected along a longitudinal length of juncture of a second wall with one of a third wall; and c. intersecting members each extending in coplanar disposition from respective remaining third walls of said peripheral members at juncture of said remaining third walls with said second wall; said second walls of said peripheral members and said intersecting members defining and open ended longitudinally extending transversely closed hollow interior between said peripheral members wherein the longitudinally elongated members further comprise a longitudinally elongated interior wall parallel to and disposed between said second exterior wall and said guide members, the interior wall adjoining along its longitudinal length said third exterior walls further comprising longitudinally elongated insert fillers for insertion into said peripheral members between said first exterior walls and said guide members wherein said insert fillers have set screws attached thereto, said set screws extending inwardly through said second channels and engaging said interior walls, the set screws biasing said insert fillers frictionally against said first exterior walls.

* * * * *